US006532596B1

(12) United States Patent
Fosmo

(10) Patent No.: US 6,532,596 B1
(45) Date of Patent: Mar. 18, 2003

(54) BIB-LIKE COVER

(76) Inventor: Dana C. Fosmo, 9371 Williamette Meridian NW., Silverdale, WA (US) 98383

( * ) Notice: Subject to any disclaimer, the term of this patent is extended or adjusted under 35 U.S.C. 154(b) by 0 days.

(21) Appl. No.: 10/252,169

(22) Filed: Sep. 23, 2002

(51) Int. Cl.[7] ..... A41B 13/10; A41D 3/00; A41D 11/00

(52) U.S. Cl. ..... 2/49.1; 2/46; 2/84; 2/202

(58) Field of Search ..... 2/49.1, 48, 46, 2/84, 202, 204, 49.4, 51, 410, 417, 88, 92, 111, 69, 69.5, 205; D2/825, 831, 826, 828, 860, 861, 862, 866, 867

(56) References Cited

U.S. PATENT DOCUMENTS

| | | | | | |
|---|---|---|---|---|---|
| 455,490 | A | | 7/1891 | Pratt | |
| 540,756 | A | | 6/1895 | O'Dell | |
| 1,167,058 | A | * | 1/1916 | Finberg | 2/84 |
| D59,555 | S | | 11/1921 | Ladd | |
| D104,490 | S | | 5/1937 | Anderson | |
| 2,131,248 | A | * | 9/1938 | Astrove | 2/84 |
| 2,567,192 | A | * | 9/1951 | De Grazia | 2/205 |
| 2,621,331 | A | * | 12/1952 | Loretto | 2/75 |
| 2,870,452 | A | * | 1/1959 | De Grazia | 2/203 |
| 3,084,346 | A | * | 4/1963 | Stelter | 2/84 |
| 3,147,490 | A | * | 9/1964 | Allen et al. | 2/84 |
| 3,531,952 | A | * | 10/1970 | Chesebro | 2/202 |
| 5,211,668 | A | | 5/1993 | Secord | |
| D349,595 | S | | 8/1994 | Miltz, Jr. | |
| 5,339,466 | A | * | 8/1994 | McMullen | 2/203 |
| 5,606,746 | A | * | 3/1997 | Shelton et al. | 2/102 |
| 5,664,258 | A | * | 9/1997 | Harris | 2/84 |
| 5,855,021 | A | * | 1/1999 | Somerville | 2/84 |
| 6,185,743 | B1 | * | 2/2001 | Mick | 2/84 |
| 6,353,933 | B1 | * | 3/2002 | Love | 2/88 |
| 6,425,138 | B1 | * | 7/2002 | Johnson | 2/202 |

* cited by examiner

*Primary Examiner*—Amy B. Vanatta
(74) *Attorney, Agent, or Firm*—Donald R. Schoonover

(57) ABSTRACT

A cover fits over a wearer's head, shoulders, back and chest to protect the wearer during feeding. The cover includes a collar portion that can stretch and deform to accommodate different sizes of persons.

2 Claims, 1 Drawing Sheet

BIB-LIKE COVER

BACKGROUND OF THE INVENTION

1. Field of the Invention

The present invention relates to the general art of wearing apparel, and to the particular field of bibs.

2. Discussion of the Related Art

Feeding an infant can be a messy job. As any person who has undertaken this task can attest, the infant sometimes deposits more food on themselves than in their mouth. In some instances, the infant must actually be bathed in order to remove the food. This may is also the case when feeding handicapped, elderly, and mentally-challenged persons For this reason, the wearing apparel art contains many inventions related to bibs which will protect the front of the wearer from food that is dropped. These bibs work well to protect a part of the wearer and, perhaps, some of the wearer's clothing.

However, many infants or mentally-challenged persons have a habit of rubbing food into their hair and around their faces. A bib that protects the front of their clothing will not protect the wearer's head. Thus, even though the wearer has worn a bib, a caretaker finds herself bathing the wearer anyway.

Therefore, there is a need for a bib-like cover which completely protects a wearer. In particular, there is a need for an infant bib which covers the infant's head.

While the wearing apparel art does contain examples of bibs that can protect the wearer's hair, these bibs have several shortcomings that prevent their full acceptance.

For example, the head portion of such bibs may not fit all infants. That is, if one infant is larger than another, one of the infants may not be fully protected. Still further, the bib may not be comfortable for the wearer, who may then object to wearing the bib. If a bib fits an infant at one time, the infant is likely to outgrow the bib. This may force a caretaker to purchase a bib that is too large or to purchase additional bibs as the infant grows. As above discussed, if the bib does not properly fit the wearer, it may not adequately protect the wearer.

Therefore, there is a need for an bib which is comfortable for the wearer. There is yet a further need for a bib which can account for size of the wearer.

Many people like to take their infants out to eat. Even in such situations, many infants require a bib. Many people like to have the infant well dressed when dining out. However, many bibs are designed for protection and not for style. In such instances, the caretaker must make a decision about whether to use a bib that is functional but is not aesthetically pleasing, or to purchase a separate bib that can be aesthetically pleasing, but which may not fully protect the infant.

Therefore, there is a need for an infant bib which has an aesthetically pleasing appearance yet will fully protect the infant.

PRINCIPAL OBJECTS OF THE INVENTION

It is a main object of the present invention to provide a bib-like cover which completely protects a wearer.

It is another object of the present invention to provide a bib which covers the wearer's head.

It is another object of the present invention to provide a bib which is comfortable for the wearer.

It is another object of the present invention to provide an bib which can account for size of the wearer.

It is another object of the present invention to provide a bib which has an aestheically pleasing appearance, yet still fully protects the wearer.

SUMMARY OF THE INVENTION

These, and other, objects are achieved by a bib-like cover which comprises a body portion which includes a shoulder portion which extends over a wearer's shoulders when worn, a back portion which is located adjacent to the wearer's back when worn, and a front portion which is located adjacent to a wearer's chest when worn; a head portion which extends over a wearer's head when worn and which includes an expansion joint; a collar portion which completely surrounds a wearer's neck when worn and which includes an inferior rim fixed to the body portion and a superior rim fixed to the head portion, the collar portion being in overlapping relationship with the head portion; an inferior rim on the back portion of the body portion; an inferior rim on the front portion of the body portion, the inferior rim on the back portion of the body portion being superior to the inferior rim on the front portion of the body portion with respect to the wearer when the body portion is worn; the body portion and the head portion and the collar portion all being one piece and unitary with each other; and the neck portion being formed of stretchable material.

The specific formation of the bib-like cover allows the cover to completely surround the wearer's head and face during feeding yet will be comfortable, even if used on wearer's of different sizes and will still remain aesthetically pleasing. The expandable nature of the bib will permit the bib to be used even if an infant grows. The bib is formed of easily washable materials and thus is easy to care for and clean.

BRIEF DESCRIPTION OF THE DRAWING FIGURES

DETAILED DESCRIPTION OF THE INVENTION

Figures 1, 2:
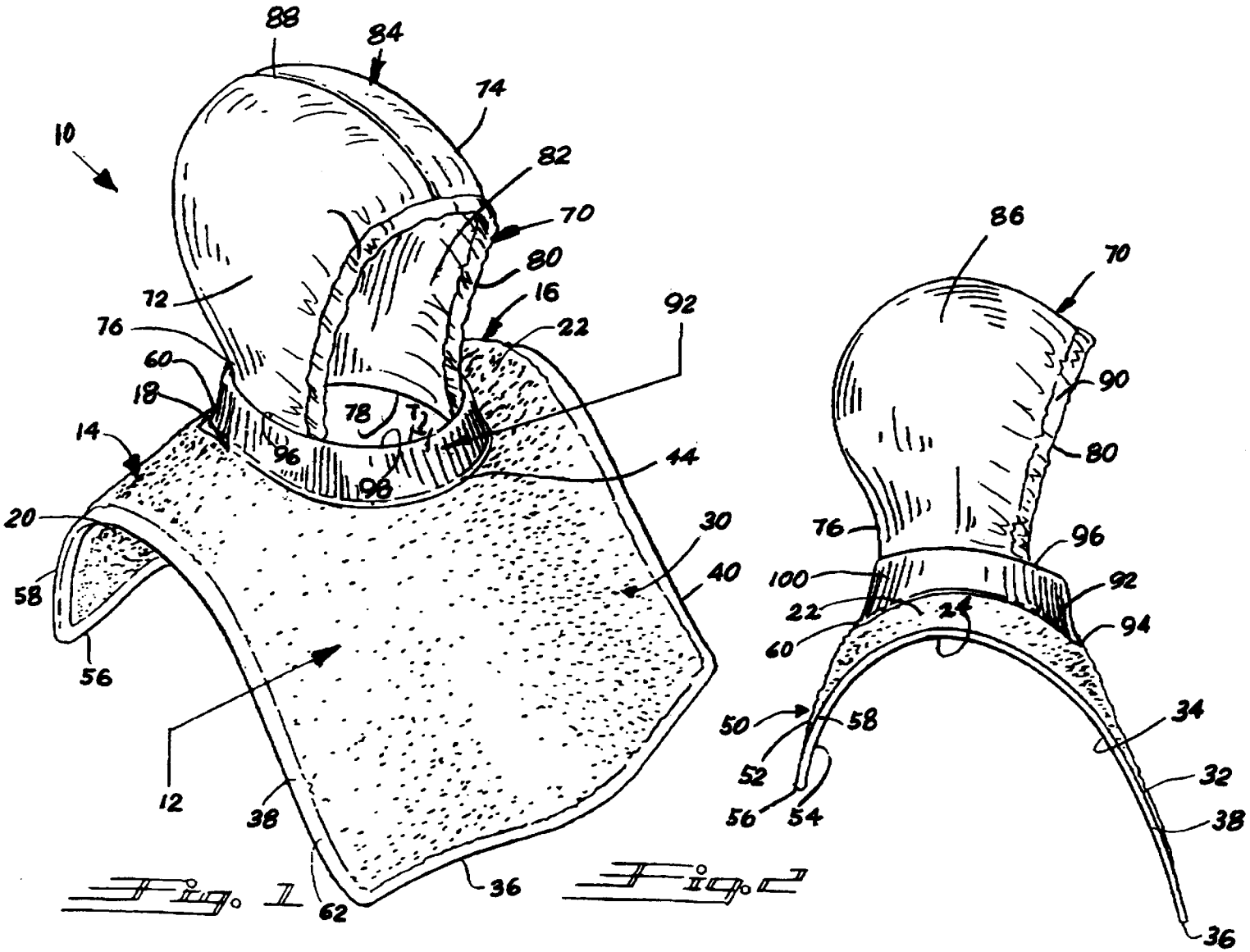
FIG. 1 is a front perspective view of a bib-like cover embodying the present invention.
FIG. 2 is a side elevataional view of the bib-like cover shown in FIG. 1, the opposite side being identical to the side shown in FIG. 2.

Other objects, features and advantages of the invention will become apparent from a consideration of the following detailed description and the accompanying drawings.

Referring to the figures, it can be understood that the present invention is embodied in a bib-like cover 10 which comprises a one-piece body cover 12 which includes two identical shoulder sections 14 and 16 each of which covers a shoulder area of a wearer when body cover 12 is in place on the wearer. The shoulder sections 14, 16 are identical so only one shoulder section will be described with the description being applicable to either shoulder section. Each shoulder section has a neck area 18 which is located next to a wearer's neck when the shoulder section is in place on the wearer, an outer rim 20 which is located next to a wearer's deltoid area and which is spaced apart from the neck area 18 of the shoulder section when the bib and the shoulder section is in place on the wearer. Each shoulder section further includes a shoulder section outer surface 22 and a shoulder section bottom surface 24 which is located adjacent to the wearer when the shoulder section is in place on the wearer.

The body cover 12 of the bib further includes a front cover 30 which covers a chest area of the wearer when in place and which includes a front cover outer surface 32 which is one-piece and unitary with the shoulder section outer surface 22 of the shoulder sections and a front cover bottom surface 34 which is located adjacent to the wearer when the front cover is in place and which is one-piece and unitary with the shoulder section bottom surface 24 of the shoulder sections. A front cover inferior rim 36 is positioned on a wearer's chest when the bib is worn and two front cover side rims 38 and 40 extend from the front cover inferior rim 36 over the wearer's shoulder and are one-piece and unitary with the outer rims 20 of the shoulder sections. A neck area 44 of the front cover 30 is located next to the neck area of an wearer when the front cover 30 is in place on the wearer.

The body cover 12 of the bib 10 further includes a rear cover 50 which covers a back area of the wearer when in place and includes a rear cover outer surface 52 which is one-piece and unitary with the shoulder section outer surface 22 of the shoulder sections and a rear cover bottom surface 54 which is located adjacent to the wearer when the rear cover 50 is in place. The rear cover bottom surface 54 is one-piece and unitary with the shoulder section bottom surface 24 of the shoulder sections. The rear cover 50 further includes a rear cover inferior rim 56. Rear cover inferior rim 56 is located in a position which is superior to front cover inferior rim 36 with respect to the neck of the wearer when the body cover is in place on the wearer.

Two rear cover side rims, such as side rim 58, are one-piece and unitary with the outer rims 20 of the shoulder sections. Rear cover 50 further includes a neck area 60 which is located next to the neck area of a wearer when the rear cover 50 is in place on the wearer.

The neck areas 18 of the shoulder sections, the front cover 30 and the rear cover 50 are continuous and uninterrupted with each other and completely surround the neck of the wearer when the body cover 12 is in place on the wearer. The outer rims 20 of the shoulder sections and the side rims of the front cover 30 and the rear cover 50 are continuous and uninterrupted with each other to define a one-piece outer rim extending from the rear cover inferior rim 56 to the front cover inferior rim 36. A one-piece uninterrupted hem 62 is located on the outer rims 20 of the shoulder sections and the side rims of the front and rear covers 30, 50 and on the rear cover inferior rim 56 and on the front cover inferior rim 36.

The bib 10 further includes a head cover 70 which covers a wearer's head when in place. Head cover 70 includes two side sections 72 and 74 and a neck area 76 which is located next to the neck of the wearer when the head cover 70 is worn. The neck area 76 includes a neck rim 78 and a face rim 80. Face rim 80 is located adjacent to a wearer's face when the head cover 70 is worn. An inside surface 82 of the head cover 70 is located adjacent to the wearer's head when the head cover 70 is worn. The head cover 70 further includes an outside surface 84.

The head cover 70 further includes a one-piece body 86 which extends from the neck rim 78 of the neck area 76 of each of the two side sections 72, 74 and from the face rim 80 and covers the wearer's head when the head cover 70 is worn. An expansion joint 88 is defined in the body 86 of the head cover 70 to extend from the face rim 80 to the neck area 76. The expansion joint 88 permits the head cover 70 to fit snugly about a wearer's head and will accommodate various head sizes. This will permit one bib to be used on a growing child and/or on children of several different head sizes and remain secure and snug. A face hem 90 is located adjacent to the face rim 80 of the head cover 70.

A neck portion 92 completely surrounds the wearer's neck when the bib 10 is worn. Neck portion 92 includes an inferior rim 94 which is one-piece and unitary with the body cover 12, and a superior rim 96 which is one-piece and unitary with the head cover 70. An inside surface 98 of the neck portion 92 is located adjacent to the outside surface 84 of the head cover 70, and an outside surface 100 of the neck portion 92 is spaced apart from the inside surface 98 of the neck portion 92. A thickness dimension T of the neck portion 92 is measured between the inside surface 98 of the neck portion 92 to the outside surface 100 of the neck portion 92.

The outside surface 84 of the head cover 70 is spaced apart from the outside surface 100 of the neck portion 92 by a distance equal to the thickness of the neck portion 92. The inferior rim 94 of the neck portion 92 is coincident with the neck rim 78 of the neck area 76 of the head cover 70, and the neck portion 92 is in overlapping relationship with the head cover 70 in the neck area 76 of the head cover 70. The neck portion 92 is formed of stretchable knit fabric. The outer surfaces of the body cover 12 are covered by washable material, such as cotton or the like so the bib 10 can be easily laundered. The body cover 12 and the neck portion 92 and the head cover 70 are all one-pieced and unitary with each other so the bib 10 can be cleaned and no food can become lodged in crevices or the like.

It is understood that while certain forms of the present invention have been illustrated and described herein, it is not to be limited to the specific forms or arrangements of parts described and shown.

What is claimed is:

1. A bib-like cover comprising:

a) a one-piece body cover which includes (1) two shoulder sections each of which covers a shoulder area of a wearer when said body cover is in place on the wearer, each shoulder section having (A) a neck area which is located next to a wearer's neck when said each shoulder section is in place on the wearer, (B) an outer rim which is located next to a wearer's deltoid area and which is spaced apart from the neck area of said each shoulder section when said each shoulder section is in place on the wearer, (C) a shoulder section outer surface, and (D) a shoulder section bottom surface which is located adjacent to the wearer when said each shoulder section is in place;

(2) a front cover which covers a chest area of the wearer when in place and which includes (A) a front cover outer surface which is one-piece and unitary with the shoulder section outer surface of said shoulder sections, (B) a front cover bottom surface which is located adjacent to the wearer when said front cover is in place and which is one-piece and unitary with the shoulder section bottom surfce of said shoulder sections, (C) a front cover inferior rim, (D) two front cover side rims that are one-piece and unitary with the outer rims of said shoulder sections, and (E) a neck area which is located next to the neck area of a wearer when said front cover is in place on the wearer, (3) a rear cover which covers a back area of the wearer when in place and which includes (A) a rear cover outer surface which is one-piece and unitary with the shoulder section outer surface of said shoulder sections, (B) a rear cover bottom surface which is located adjacent to the wearer when said rear cover is in place and which is one-piece and unitary with the shoulder section bottom surfce of said shoulder sections, (C) a rear cover inferior rim, the rear cover inferior rim being located in a position which is superior to the front cover inferior rim with respect to the neck of the wearer when said body cover is in place on the wearer, (D) two rear cover side rims that are one-piece and unitary with the outer rims of said shoulder sections, and (E) a neck area which is located next to the neck area of a wearer when said rear cover is in place on the wearer, (4) the neck areas of said shoulder sections, said front cover and said rear cover being continuous and uninterrupted with each other and completely surrounding the neck of the wearer when said body cover is in place on the wearer, (5) the outer rims of said shoulder sections and the side rims of said front cover and said rear cover being continuous and uninterrupted with each other to define a one-piece outer rim extending from the rear cover inferior rim to the front cover inferior rim, and (6) a one-piece uninterrupted hem located on the outer rims of said shoulder sections and the side rims of said front and rear cover and on the rear cover inferior rim and on the front cover inferior rim;

b) a head cover which covers a wearer's head when in place and which includes (1) two side sections, (2) a neck area located next to the neck of the wearer when said head cover is worn, the neck area including a neck rim, (3) a face rim that is located adjacent to a wearer's face when said head cover is worn, (4) an inside surface that is located adjacent to the wearer's head when said head cover is worn, (5) an outside surface, (6) a one-piece body which extends from the neck rim of the neck area of each of the two side sections and from the face rim and covers the wearer's head when said head cover is worn, (7) an expansion joint in the body of said head cover and which extends from the face rim to the neck area, and (8) a face hem located adjacent to the face rim of said head cover;

c) a neck portion which completely surrounds the wearer's neck when worn and which includes (1) an inferior rim which is one-piece and unitary with said body cover, (2) a superior rim which is one-piece and unitary with said head cover, (3) an inside surface which is located adjacent to the outside surface of said head cover, (4) an outside surface which is spaced apart from the inside surface of said neck portion, (5) a thickness dimension of said neck portion measured between the inside surface of said neck portion to the outside surface of said neck portion, (6) the outside surface of said head cover being spaced apart from the outside surface of said neck portion by a distance equal to the thickness of said neck portion, (7) the inferior rim of said neck portion being coincident with the neck rim of the neck area of said head cover, and (8) said neck portion being in overlapping relationship with said head cover in the neck area of said head cover;

d) said neck portion being formed of stretchable knit fabric; and e) said body cover and said neck portion and said head cover all being one-pieced and unitary with each other.

2. A bib comprising:

a) a body portion which includes a shoulder portion which extends over a wearer's shoulders when worn, a back portion which is located adjacent to the wearer's back when worn, and a front portion which is located adjacent to the wearer's chest when worn;

b) a head portion which extends over the wearer's head when worn and which includes an expansion joint;

c) a collar portion which completely surrounds the wearer's neck when worn and which includes an inferior rim fixed to said body portion and a superior rim fixed to said head portion, said collar portion being in overlapping relationship with said head portion;

d) an inferior rim on the back portion of said body portion;

e) an inferior rim on the front portion of said body portion, the inferior rim on the back portion of said body portion being superior to the inferior rim on the front portion of said body portion with respect to the baby when said body portion is worn;

f) said body portion and said head portion and said collar portion all being one piece and unitary with each other; and g) said collar portion being formed of stretchable material.

* * * * *